US007930988B1

(12) United States Patent
Chen

(10) Patent No.: US 7,930,988 B1
(45) Date of Patent: Apr. 26, 2011

(54) JOINT ASSEMBLY FOR A BOAT SEAT

(75) Inventor: Kate Chen, Corinth, TX (US)

(73) Assignee: Friend Success Inc., Corinth, TX (US)

( * ) Notice: Subject to any disclaimer, the term of this patent is extended or adjusted under 35 U.S.C. 154(b) by 0 days.

(21) Appl. No.: 12/433,323

(22) Filed: Apr. 30, 2009

(51) Int. Cl.
*B63B 17/00* (2006.01)

(52) U.S. Cl. ..... 114/363; 52/586.2; 52/592.1

(58) Field of Classification Search ..... 114/363; 297/232; 52/233, 588.1, 241, 270, 455, 582.1, 52/586.2, 592.1
See application file for complete search history.

(56) References Cited

U.S. PATENT DOCUMENTS

| | | | | | |
|---|---|---|---|---|---|
| 2,801,895 | A | * | 8/1957 | Gass | 403/381 |
| 3,090,086 | A | * | 5/1963 | Fata | 403/381 |
| 3,664,011 | A | * | 5/1972 | Labastrou | 144/347 |
| 4,909,177 | A | * | 3/1990 | Jones | 114/363 |
| 5,154,134 | A | * | 10/1992 | Goldsmith | 114/363 |
| 5,475,960 | A | * | 12/1995 | Lindal | 52/233 |

* cited by examiner

*Primary Examiner* — Lars A Olson
(74) *Attorney, Agent, or Firm* — Howison & Arnott, L.L.P.

(57) ABSTRACT

A joint assembly for a boat seat is provided. In one example, the joint assembly includes a front panel having a T-shaped opening formed by a groove and a channel. An end panel is configured to couple to the front panel via a T-shaped member formed by a tongue joined to a neck. A T-shaped insert is configured to slidingly engage the groove and channel after the end panel has been inserted in order to lock the end panel in place.

1 Claim, 4 Drawing Sheets

JOINT ASSEMBLY FOR A BOAT SEAT

TECHNICAL FIELD

This invention is related to the field of furniture and, more specifically, to a boat seat that can be assembled and disassembled.

BACKGROUND

Seats may be used in many different environments. One such environment is on boats or other watercraft, where seats are often exposed to weather and otherwise subjected to relatively harsh conditions. Furthermore, it may be desirable to ship and/or store seats, and having to ship and store seats in a fully assembled state may be costly and inefficient due to the amount of space a fully assembled seat may occupy.

A seat that can assembled and disassembled may develop issues over time as the means for joining the various components forming the seat may loosen or otherwise fail to securely maintain the seat's designed shape. This design issue is further complicated for seats such as boat seats that are designed for exposure to water and other elements, as the construction of such seats may be limited to using only materials that are relatively weather resistant.

SUMMARY

Provided is a joint assembly for a boat seat comprising a front panel, an end panel, an insert, and a fastener. The front panel has a groove disposed on an interior surface thereof and a substantially rectangular channel running parallel to the groove and positioned between the groove and an exterior surface of the front panel. The groove runs from an upper edge of the front panel to a lower edge of the front panel and the channel runs from the upper edge of the front panel to a point that is a distance D1 above the lower edge of the front panel, wherein a width of the channel is larger than a width of the groove to form a "T" shaped opening. The end panel has a shaped end that includes a tongue portion having a substantially rectangular shape that is configured to slidingly engage the channel and a neck portion that is configured to slidingly engage the groove. The neck portion runs from an upper edge of the end piece to a lower edge of the end piece and the tongue portion runs from the upper edge of the end piece to a point that is at least the distance D1 above the lower edge of the end piece. The upper edge of the end piece is a distance D2 lower than the upper edge of the front panel so that a length D2 of the groove is exposed. The insert has an elongated outer portion configured to slidingly engage the groove and an elongated inner portion that has a substantially rectangular shape and that is configured to slidingly engage the channel. The insert has a length no greater than D2, and includes a bore substantially perpendicular to the inner and outer portions. The threaded fastener is configured to pass through at least a portion of the bore and abut a surface of the front panel forming the channel.

BRIEF DESCRIPTION OF THE DRAWINGS

For a more complete understanding, reference is now made to the following description taken in conjunction with the accompanying Drawings in which.

DETAILED DESCRIPTION

Figure 1:
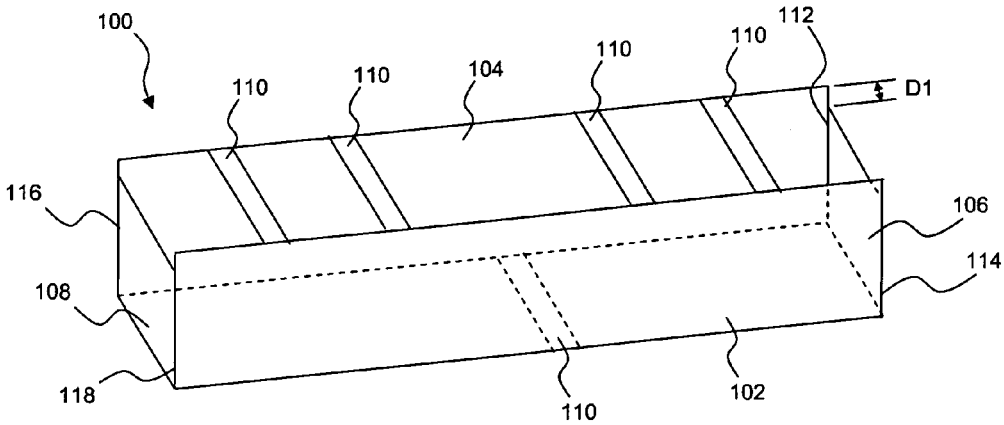
FIG. 1 illustrates a front perspective view of one embodiment of a boat seat.

Referring now to the drawings, wherein like reference numbers are used herein to designate like elements throughout, the various views and embodiments of a boat seat joint assembly are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring to FIG. 1, one embodiment of a boat seat 100 is illustrated. The boat seat 100 includes a front panel 102, a back panel 104, and first and second end panels 106 and 108. One or more cross-members 110 may extend from the front panel 102 to the back panel 104. Although not shown, it is understood that one or more cross-members may extend from the first end panel 106 to the second end panel 108. Although not shown, a cushion may be placed on the boat seat 100 and supported by the upper layer of cross-members 110, as well as the edges of the front panel 102, back panel 104, and first and second end panels 106 and 108.

The boat seat 100 may be assembled and disassembled. More specifically, the front panel 102 and back panel 104 are joined by the first and second end panels 106 and 108 using a tongue-in-groove type joint. This will be described in greater detail below. The cross-members 110 provide support for the boat seat 100 and may, in some embodiments, provide further fastening functionality. Although not shown, a cushion may be placed on the boat seat 100.

The front panel 102, back panel 104, and first and second end panels 106 and 108 may be made of molded plastic or any other suitable material, and may have various structural features (not shown) designed to strengthen the various components. An upper edge of each of the first and second end panels 106 and 108 is offset by a distance "D1" from an upper edge of the front panel 102 and back panel 104. For purposes of example, the following disclosure described portions of the back panel 104 and first end panel 106, as well as how the back panel and first end panel are joined using a joint 112. It is understood that other joints 114, 116, and 118 may be similar or identical to the joint 112.

Figure 2:
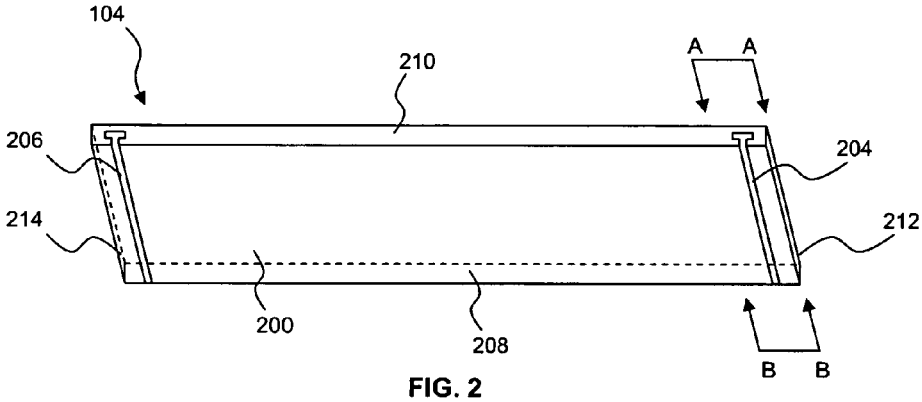
FIG. 2 illustrates a front perspective view of one embodiment of a back panel of the boat seat of FIG. 1.

Referring to FIG. 2, one embodiment of the back panel 104 is illustrated in greater detail. The back panel 104 includes an interior side 200 that faces the front panel 102 when the boat seat 100 is in an assembled state, and an exterior side 202 (see FIGS. 3A and 3B). The interior side 200 includes first and second grooves 204 and 206 that run vertically from a lower edge 208 of the interior side 200 to an upper edge 210. In the present example, the first groove 204 is positioned near a first end 212 of the back panel 104 and the second groove 206 is positioned near a second end 214 of the back panel 104.

Figure 3A:
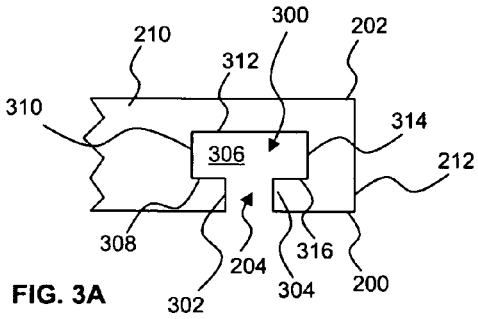
FIG. 3A illustrates a top view of one embodiment of one end of the back panel of FIG. 2 along lines A-A.
Figure 3B:
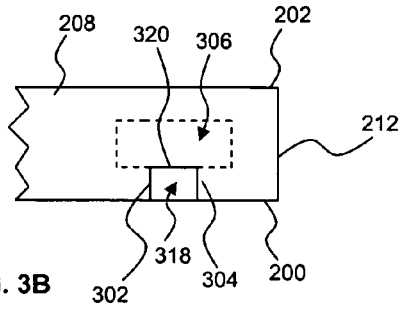
FIG. 3B illustrates a bottom view of one embodiment of one end of the back panel of FIG. 2 along lines B-B.

With additional reference to FIGS. 3A and 3B, one embodiment of the first end 212 of the back panel 104 is illustrated in greater detail. FIG. 3A illustrates a top view of the first end 212 (i.e., facing the upper edge 210) and FIG. 3B illustrates a bottom view of the first end (i.e., facing the lower edge 208).

Referring specifically to FIG. 3A, the upper edge 210 includes a shaped aperture 300 that provides access to the groove 204 that runs vertically from the upper edge 210 to the lower edge 208. In the present example, the shaped aperture 300 includes the groove 204 that is defined by surfaces 302 and 304, and a larger (relative to the groove 204) channel 306 defined by interior surfaces 308, 310, 312, 314, and 316. The groove 204 and channel 306 combine to form a "T" shaped opening, although it is understood that the groove 204 and/or aperture 306 may be shaped differently than those shown in the Figures.

Referring specifically to FIG. 3B, the lower edge 208 includes a shaped aperture 318 that provides access to the groove 204, which is defined by surfaces 302, 304, and 320. However, the aperture 318 does not provide access to the channel 306. Accordingly, the channel 306 runs parallel to the groove 204 down substantially the entire length of the groove 204, but ends before opening at the lower edge 208. In some embodiments, the shaped aperture 318 may not be present at all, and the lower edge 208 may present a single unbroken surface, or the shaped aperture 318 may provide access to the channel 306.

Figure 4:
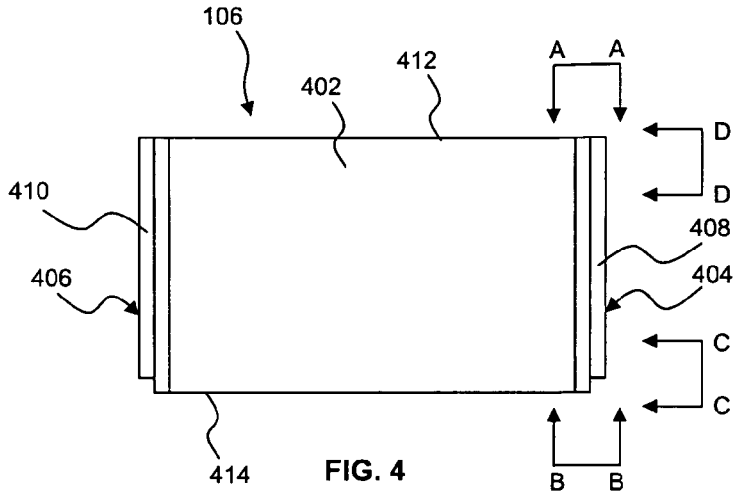
FIG. 4 illustrates a front view of one embodiment of a side panel of the boat seat of FIG. 1.

Referring to FIG. 4, one embodiment of the first end panel 106 is illustrated in greater detail. The first end panel 106 includes an interior side 400 (see FIGS. 5A and 5B) that faces the second end panel 108 when the boat seat 100 is in an assembled state, and an exterior side 402. The first end panel 106 includes first and second shaped ends 404 and 406 that include mating features 408 and 410, respectively, configured to mate with the groove 204 and channel 306 and a similar groove (not shown) on the front panel 102. An upper edge 412 and a lower edge 414 extend between the first and second shaped ends 404 and 406.

Figure 5A:
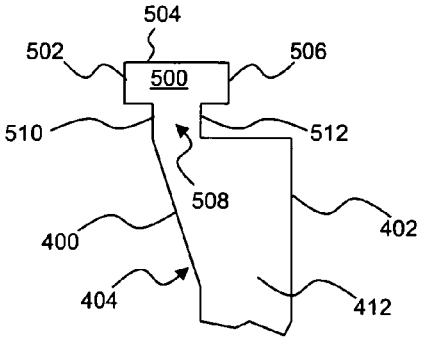
FIG. 5A illustrates a top view of one embodiment of one end of the side panel of FIG. 4 along lines A-A.
Figure 5B:
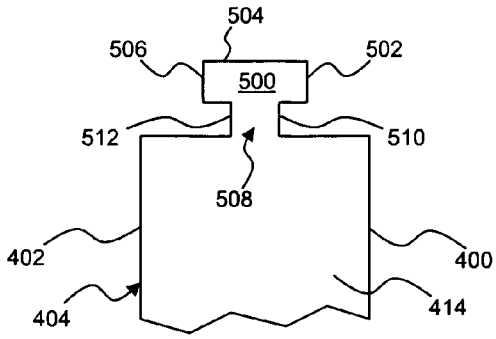
FIG. 5B illustrates a bottom view of one embodiment of one end of the side panel of FIG. 4 along lines B-B.

With additional reference to FIGS. 5A and 5B, one embodiment of the first shaped end 404 of the first end panel 106 is illustrated in greater detail. FIG. 5A illustrates a top view of the first shaped end 404 (i.e., facing the upper edge 412) and FIG. 5B illustrates a bottom view of the first end (i.e., facing the lower edge 414).

Referring specifically to FIG. 5A, the first shaped end 404 includes a tongue portion 500 defined by surfaces 502, 504, and 506. The tongue portion 500 is coupled to the first end panel 106 via a neck portion 508 defined by surfaces 510 and 512 to form a "T" shape. The tongue portion 500 is sized to fit within the channel 306 of the back panel 104, and the neck portion 508 is sized to fit within the groove 204. The tongue portion 500 and neck portion 508 may be sized with relatively little room between the tongue portion 500 and channel 306 and between the neck portion 508 and groove 204 (e.g., in an interference fit), or the fit may be looser and may allow some movement between the back panel 104 and first end panel 106. In the present example, a portion of the upper edge 412 slopes away somewhat from the surface 510. It is understood that the tongue portion 500 and/or neck portion 508 may be shaped differently than those shown in the Figures, but will generally resemble the shape of the groove 204 and aperture 306, respectively. Referring specifically to FIG. 5B, the tongue portion 500 and neck portion 508 are present with the surfaces described above. In the present example, the lower edge 414 does not slope in the same manner as the upper edge 412.

Figure 6A:
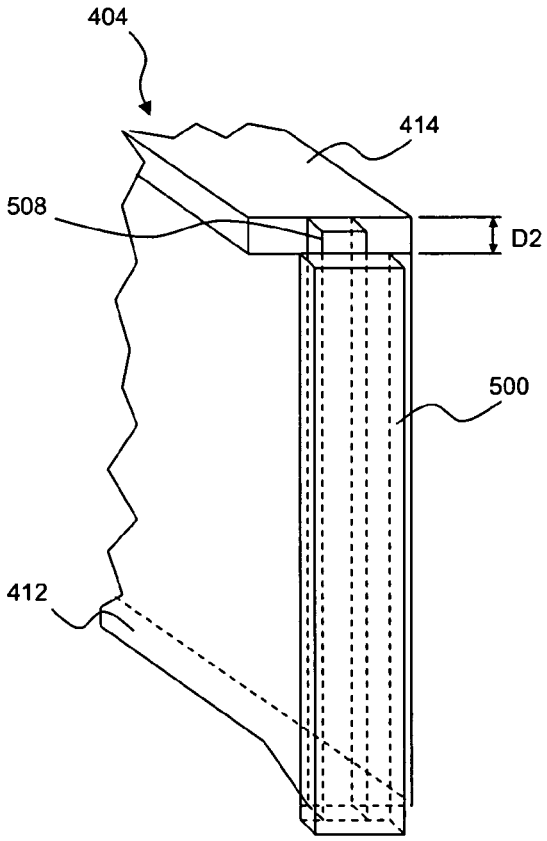
FIG. 6A illustrates a side bottom perspective view of one embodiment of one end of the side panel of FIG. 4 along lines C-C.
Figure 6B:
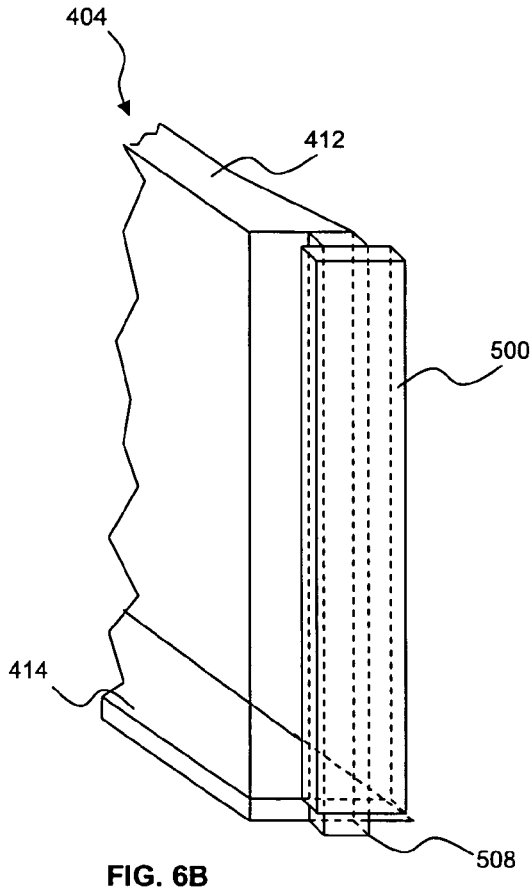
FIG. 6B illustrates a side top perspective view of one embodiment of one end of the side panel of FIG. 4 along lines D-D.

Referring again to FIG. 4 and with additional reference to FIGS. 6A and 6B, the tongue portion 500 may not extend all the way down the first shaped end 404 to the lower edge 414. As illustrated in FIG. 6A, which shows the first shaped end 414 from the perspective of the lower edge 414, the tongue portion 500 may be offset from the lower edge 414 by a space D2, while the neck portion 508 may be substantially even with the lower edge 414. When assembled, the offset provided by the space D2 enables the neck portion 508 to enter the shaped aperture 318 of the lower edge 208 in the back panel 104. As illustrated in FIG. 6B, both the tongue portion 500 and the neck portion 508 may be relatively even with the upper edge 412.

Referring to FIGS. 7A-7D, one embodiment of an insert 700 is illustrated. The insert 700 is substantially the same length as the distance D1 in FIG. 1, but it is understood that other dimensions may be used. The insert 700 in the present example is formed from molded plastic, but may be made of any other suitable material. The insert 700 is shaped with an outer portion 702 sized to fit within the groove 204 of the back panel 104 and an inner portion 704 sized to fit within the channel 306. Accordingly, the outer portion 702 and inner portion 704 may be sized similarly to the neck portion 508 and tongue portion 500, respectively, of the first shaped end 404 of the first end panel 106. The insert 700 also includes a bore 706, which may receive a threaded fastener 708.

Figure 7A:
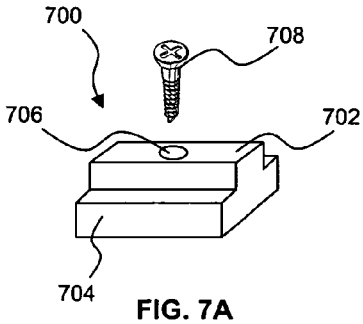
FIGS. 7A-7D illustrate side perspective, end, top, and bottom views of one embodiment of an insert that may be used with the boat seat of FIG. 1.
Figure 7B:
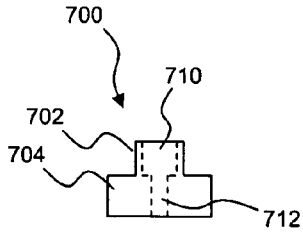
Figure 7C:
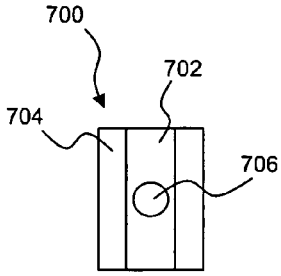
Figure 7D:
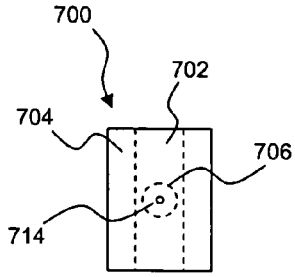

With specific reference to FIG. 7B, the bore 706 may include an upper portion 710 that is wide enough to receive the fastener 708 (including a head or other gripping surface) and a lower portion 712 that is narrower than the upper portion and allows only a portion of the fastener to pass therethrough. With specific reference to FIG. 7D, a surface of the inner portion 704 may include a relatively small opening 714 that connects to the bore 706 to allow the fastener 708 to engage the surface 312 of the channel 306.

Figure 8A:
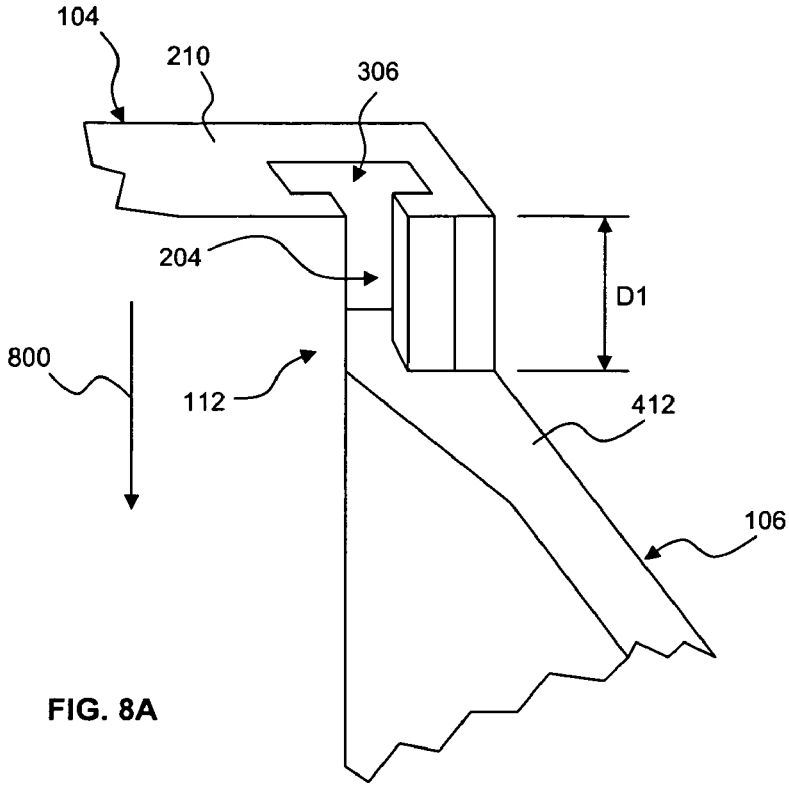
FIG. 8A illustrates a joint formed by the side panel of FIG. 4 interlocked with the back panel of FIG. 2.
Figure 8B:
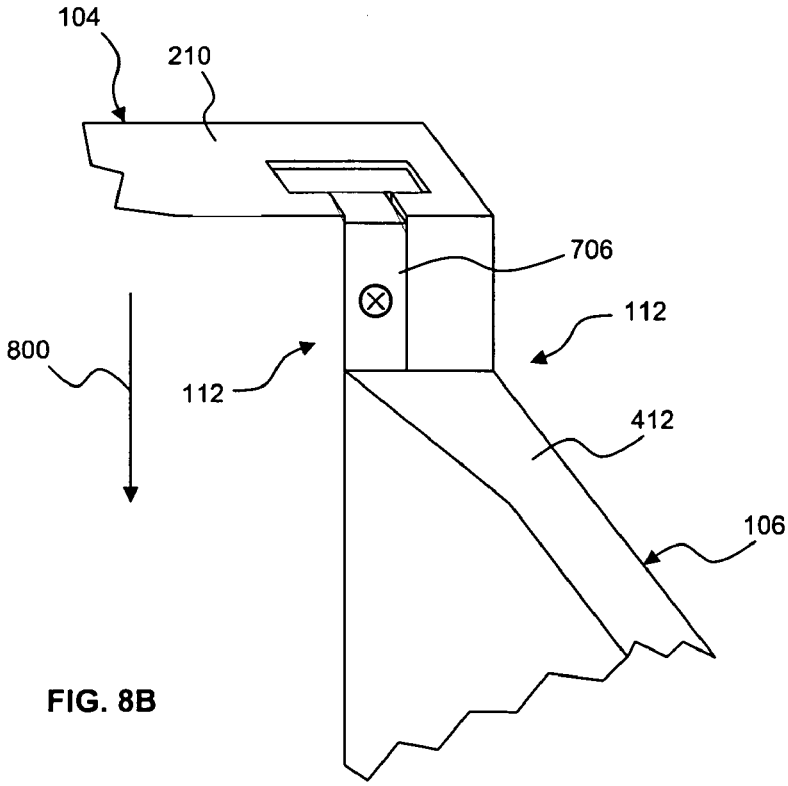
FIG. 8B illustrates the joint of FIG. 8A in a stabilized state with the addition of the insert of FIG. 7.

Referring to FIGS. 8A and 8B, the joint 112 between the back panel 104 and first end panel 106 is illustrated in greater detail. FIG. 8A illustrates the first end 212 of the back panel 104 and the first shaped end 404 of the first end panel 106. The tongue portion 500 and neck portion 508 have been mated with the channel 306 and groove 204, respectively, and the first end panel 106 has been moved in a direction indicated by arrow 800 relative to back panel 104. Although not shown, at this point the neck portion 508 at the lower edge 414 has entered the shaped aperture 318 of the lower edge 208 in the back panel 104 due to the offset provided by the space D2. As can be seen, the distance D1 of FIG. 1 is present between the upper edge 412 of the first end panel 106 and the upper edge 210 of the back panel 104.

Referring specifically to FIG. 8B, the insert 700 has been mated with the channel 306 and groove 204 and moved in the direction indicated by arrow 800 relative to back panel 104. Once the insert 700 abuts the upper edge 412 of the first end panel 106, the fastener 708 may be tightened. For example, the threaded fastener 708 may be a screw that engages the bore 706 and turns in a clockwise direction until a lower end of the fastener exits the opening 714 and engages the surface

312 of the channel 306. This locks the back panel 104 and first end panel 106 into place relative to one another and stabilizes the joint 112.

It will be appreciated by those skilled in the art having the benefit of this disclosure that this boat seat joint assembly provides a means for easy assembly and disassembly while also providing a stable joint. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A joint assembly for a boat seat comprising:

a front panel having a groove disposed on an interior surface thereof and a substantially rectangular channel running parallel to the groove and positioned between the groove and an exterior surface of the front panel, wherein the groove runs from an upper edge of the front panel to a lower edge of the front panel and the channel runs from the upper edge of the front panel to a point that is a distance D1 above the lower edge of the front panel, and wherein a width of the channel is larger than a width of the groove to form a T-shaped opening;

an end panel having a shaped end that includes a tongue portion having a substantially rectangular shape and configured to slidingly engage the channel and a neck portion configured to slidingly engage the groove, wherein the neck portion runs from an upper edge of the end panel to a lower edge of the end panel and the tongue portion runs from the upper edge of the end panel to a point that is at least the distance D1 above the lower edge of the end panel, and wherein the upper edge of the end panel is a distance D2 lower than the upper edge of the front panel so that a length D2 of the groove is exposed;

an insert having an elongated outer portion configured to slidingly engage the groove and an elongated inner portion having a substantially rectangular shape and configured to slidingly engage the channel, wherein the insert has a length no greater than D2, and wherein the insert includes a bore substantially perpendicular to the inner and outer portions; and a threaded fastener configured to pass through at least a portion of the bore and abut a surface of the front panel forming the channel.

* * * * *